US005796028A

United States Patent [19]

Field et al.

[11] Patent Number: 5,796,028

[45] **Date of Patent: *Aug. 18, 1998**

[54] SOFT BODY ARMOR

[75] Inventors: Bradley J. Field; Roger Soar, both of Kelowna, Canada

[73] Assignee: Pacific Safety Products, Inc., Canada

[ * ] Notice: This patent issued on a continued prosecution application filed under 37 CFR 1.53(d), and is subject to the twenty year patent term provisions of 35 U.S.C. 154(a)(2).

[21] Appl. No.: 516,324

[22] Filed: Aug. 17, 1995

[30] Foreign Application Priority Data

Jun. 26, 1995 [CA] Canada ..... 2152663

[51] Int. Cl.[6] ..... F41H 5/04

[52] U.S. Cl. ..... 89/36.05; 89/36.02

[58] Field of Search ..... 428/911; 89/36.01, 89/36.02, 36.05

[56] References Cited

U.S. PATENT DOCUMENTS

| | | | |
|---|---|---|---|
| 4,681,792 | 7/1987 | Harpell et al. | 428/102 |
| 4,737,402 | 4/1988 | Harpell et al. | 428/252 |
| 5,179,244 | 1/1993 | Zufle | 89/36.02 |
| 5,180,880 | 1/1993 | Zufle | 89/36.02 |
| 5,306,557 | 4/1994 | Madison | 428/304.4 |
| 5,327,811 | 7/1994 | Price et al. | 89/36.05 |
| 5,440,965 | 8/1995 | Cordova et al. | 89/36.02 |

FOREIGN PATENT DOCUMENTS

| | | | |
|---|---|---|---|
| 0572965A1 | 12/1993 | European Pat. Off. | 89/36.05 |
| 94/23263 | 10/1994 | WIPO | 89/36.02 |

*Primary Examiner*—Charles T. Jordan
*Assistant Examiner*—Matthew J. Lattig

[57] ABSTRACT

Soft body armour has a ballistic panel having an interleaved construction of a generally vertically oriented plurality of layers of interleaved sheets of aramid fibre cloth and sheets of high molecular weight polyethylene filaments in a flexible resin matrix adjacently interleaved in an interleave ratio of plies of high molecular weight polyethylene filaments in a flexible resin matrix to plies of aramid fibre cloth within each layer of the plurality of layers, the plurality of layers forming a non-quilted array between a front face of the ballistic panel and a back face of the ballistic panel, wherein the interleave ratio of plies of high molecular weight polyethylene filaments in a flexible resin matrix to plies of aramid fibre cloth within each layer of the plurality of layers is between 1:1 and 4:4, and wherein the total number of the plies of high molecular weight polyethylene filaments in a flexible resin matrix is equal to or greater than the total number of the plies of aramid fibre cloth within the plurality of layers.

24 Claims, 1 Drawing Sheet

SOFT BODY ARMOR

FIELD OF THE INVENTION

This invention relates to the field of soft body armor and in particular soft body armor having protective elements incorporating aramid fiber cloth such as KEVLAR™ 129 aramid fiber woven cloth or SPECTRA SHIELD™ high molecular weight polyethylene filaments in a flexible resin matrix.

BACKGROUND OF THE INVENTION

Body armor typically comprises a jacket or vest which serves to hold sheets of typically KEVLAR™ 129 aramid fiber woven cloth, manufactured by E.I. DuPont de Nemours and Company, or other aramid fibre cloth, or SPECTRA SHIELD™ high molecular weight polyethylene filaments in a flexible resin matrix, manufactured by Allied Signal, close to the body so as to provide bullet-resistant soft body armor. Conventionally, many sheets of either aramid fiber cloth or Spectra Shield™, sometimes as many as 55 sheets, are overlaid and held as packets in pocket-like compartments within the jacket or vest. SPECTRA SHIELD™ high molecular weight polyethylene filaments in a flexible resin matrix, being overlaid synthetic fiber strands held within a resin binder, is stiffer than aramid fibre cloth which is a woven material of synthetic aramid fibers. SPECTRA SHIELD™ high molecular weight polyethylene filaments in a flexible resin matrix material is sufficiently stiff that a stack or packet of sheets may be inserted into pocket-like compartments in a jacket or vest without having to be sewn together. Aramid fiber cloth on the other hand is typically sewn together in the manner of quilting.

Previously, soft body armor has relied on individual packets of multiple plies of SPECTRA SHIELD™ high molecular weight polyethylene filaments in a flexible resin matrix and individual packets of multiple plies of aramid fiber cloth, the packets each stacked one on top of the other so as to intersperse packets of one between packets of the other. The packets are held vertically oriented within a pocket or like vertical compartment in the body armor. Applicant is aware of "POINT BLANK BODY ARMOR" of Amity, N.Y., U.S.A which markets soft body armor having interspersed packets of aramid fiber cloth and packets of SPECTRA SHIELD™ high molecular weight polyethylene filaments in a flexible resin matrix, and in particular having within a single vertical compartment front and back packets of solely aramid fiber cloth and, sandwiched in-between, a middle packet of solely SPECTRA SHIELD™ high molecular weight polyethylene filaments in a flexible resin matrix sheets. The front and back packets of aramid fiber cloth are quilted.

Applicant is aware of U.S. Pat. No. 5,179,244 which issued on Jan. 12, 1993 to T. Tyler Zufle for an invention entitled "Reinforced Soft and Hard Body Armor", U.S. Pat. No. 5,180,880 which issued on Jan. 19, 1993 to T. Tyler Zufle for an invention entitled "Soft Body Armor", and U.S. Pat. No. 5,306,557 which issued on Apr. 26, 1994 to Thomas J. Madison for an invention entitled "Composite Tactical Hard Body Armor".

Zufle '224 discloses body armour comprised of alternating multiple packets of aramid fiber cloth and SPECTRA SHIELD™ high molecular weight polyethylene filaments in a flexible resin matrix. Zufle '880 discloses body armor comprised of aramid fiber cloth outer single plies 48 and 50, eight plies of SPECTRA SHIELD™ high molecular weight polyethylene filaments in a flexible resin matrix 52 and 54 and ten plies of aramid fiber cloth 56. Madison discloses body armor which includes Spectra Shield™ layers 4, 7 and 9 and non-woven aramid fiber layers 3 and 6.

The object of the present invention is to provide soft body armor which combines the attributes of KEVLAR™ aramid fiber woven cloth or like aramid fiber cloth (hereinafter also referred to by the letter "A") and SPECTRA SHIELD™ high molecular weight polyethylene filaments in a flexible resin matrix (hereinafter also referred to by the letter "S") in an interleaved sandwich as opposed to a sandwich of packets of solely aramid fiber cloth and solely SPECTRA SHIELD™ high molecular weight polyethylene filaments in a flexible resin matrix; and in particular interleaved so as to alternate one and two sheets of aramid fiber cloth between two sheets of SPECTRA SHIELD™ high molecular weight polyethylene filaments in a flexible resin matrix; for example in the ratio of 2 sheets of SPECTRA SHIELD™ high molecular weight polyethylene filaments in a flexible resin matrix: 2 sheets of aramid fiber cloth: 2 sheets of Spectra: 1 sheet of aramid fibre cloth and so on in a 2:1 (S:A) ratio, repeated for a total of 18 sheets of SPECTRA SHIELD™ high molecular weight polyethylene filaments in a flexible resin matrix and 9 sheets of aramid fiber cloth. It has been found that this interleaved layering exhibits many improved characteristics over stacks of solely aramid fiber cloth or solely SPECTRA SHIELD™ high molecular weight polyethylene filaments in a flexible resin matrix.

SUMMARY OF THE INVENTION

It has been found that interleaving single plies of aramid fiber cloth between sheets of SPECTRA SHIELD™ high molecular weight polyethylene filaments in a flexible resin matrix in a 2:1 SPECTRA SHIELD™ high molecular weight polyethylene filaments in a flexible resin matrix: aramid fiber) ratio reduces the overall number of sheets required to provide the level of protection equivalent to that level IIA, II or IIIA prior art soft body armor incorporating a greater number of sheets. As compared to prior art soft body armor, a typical result of the soft body armor according to the present invention is a 20% decrease in weight as indicated by a decrease in areal density, a decrease in bulk, an increase in flexibility of the armor due to the interleaving of sheets of aramid fiber cloth which provide friction reducing surfaces between sheets of SPECTRA SHIELD™ high molecular weight polyethylene filaments in a flexible resin matrix (which otherwise tend to stick to one another), a decrease in cost of manufacturing of the armor due to the decreased areal density, a removal of the requirement for quilting of the aramid fiber sheets in that the SPECTRA SHIELD™ high molecular weight polyethylene filaments in a flexible resin matrix sheets lend sufficient structural rigidity to resist billowing and bunching, a decrease in the level of blunt trauma over purely aramid fiber body armor, an increase in ballistic resistance performance over purely aramid fiber body armor for bullets entering at an angle of for example 30 degrees, an increase in performance under wet conditions over purely aramid fiber body armor which typically loses 40 percent of its ballistic capability when wet, and an increase in performance over purely SPECTRA SHIELD™ high molecular weight polyethylene filaments in a flexible resin matrix body armour when soft body armor according to the present invention is heated such as by fire.

Soft body armor incorporating the present invention has a ballistic panel of a multiple interleaved, generally vertical sandwich construction of aramid fiber sheets between sheets of SPECTRA SHIELD™ high molecular weight polyethylene filaments in a flexible resin matrix. The interleaved construction may be summarized as interleaved sheets or plies interleaved in an interleave ratio within each of a plurality of layers, the layers forming a non-quilted array between the front and back faces of the ballistic panel. Each layer will always have an interleave ratio between 1:1 (Spectra:Aramid) and 4:4 (Spectra:Aramid). The interleave ratio may be between 1:1 and 3:3, or may be between 1:1 and 2:2. In these ratio ranges the ratio of plies of SPECTRA SHIELD™ high molecular weight polyethylene filaments in a flexible resin matrix to plies of aramid fiber cloth may vary but the total number of plies of SPECTRA SHIELD™ high molecular weight polyethylene filaments in a flexible resin matrix will always be equal to or greater than the total number of plies of aramid fiber cloth. The ratio of the interleaving may change from the front to the back of the ballistic panel, for example, 2:2:2:1 (S:A:S:A) . . . 2:1:2 (S:A:S), ie., initially 2:2:2:1 (S:A:S:A) then repeating layers of 2:1 (S:A), with a final backing layer of 2 sheets of SPECTRA SHIELD™ high molecular weight polyethylene filaments in a flexible resin matrix. The interleave ratio ranges within each of the layers may also be restricted to between 2:1 (S:A) and 4:2 (S:A), or the layers may have single interleave ratios of 2:1 (S:A) or 2:2 (S:A). Threat level IIA soft body armor of the present invention will have at least 5 layers of interleaved sheets interleaved according to the interleave ratio. Threat level II and IIIA soft body armor of the present invention will have at least six layers interleaved in the ballistic panel.

DETAILED DESCRIPTION OF THE PREFERRED EMBODIMENT

Figure 1:
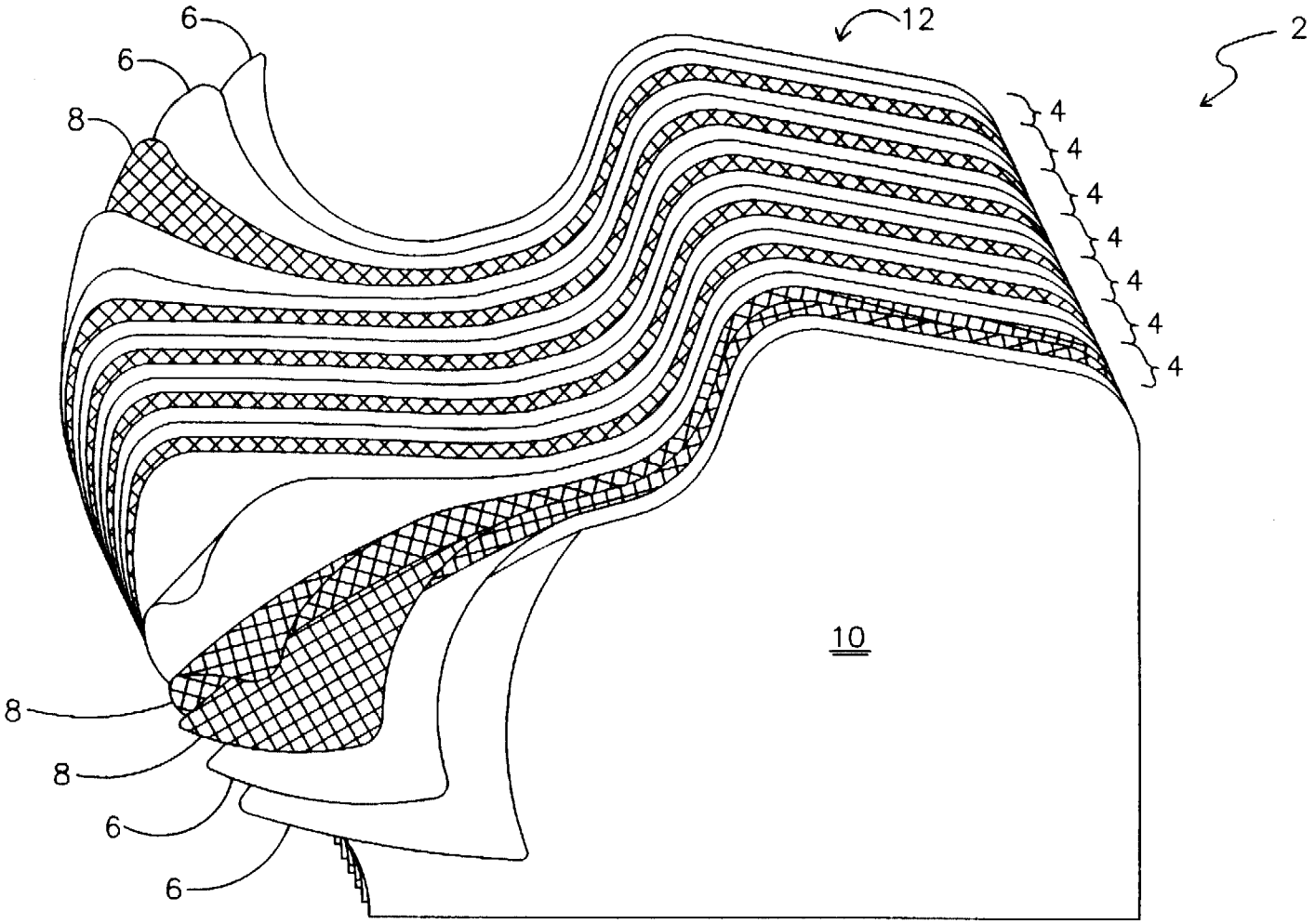
FIG. 1 is a perspective partially exploded view of a soft body armor ballistic panel of the present invention.

Ballistic fibers have several mechanical characteristics that describe how they react during an impact. One of these characteristics is mechanical impedance which is used to describe how a pressure front moves through a solid. It is proposed that a ballistic panel having an alternating or interleaved layer construction reduces blunt trauma due to the impedance mismatch the alternating layers present to the shock wave or energy front of the bullet as it impacts the ballistic panel. It is suggested that at the moment and point of impact the soft body armor ballistic panel essentially behaves as a solid laminated material block.

It is generally accepted that the longitudinal energy wave imparted to a ballistic panel by the impact of a bullet is partially converted as it passes through the ballistic panel to a transverse energy wave front. The energy wave conversion transfers part of the bullet's energy transversely down the length of the ballistic fiber (either aramid fiber or SPECTRA SHIELD™ high molecular weight polyethylene filaments in a flexible resin matrix). The partial conversion of the longitudinal energy wave into a transverse energy wave reduces the blunt trauma associated with the bullet's impact.

When an alternating, that is, interleaved, layer construction is employed in the ballistic panel, it is proposed that a further physical effect takes place that is associated with the mechanics of an energy front. When a longitudinal wave passes through a composite block of intimately bonded material and encounters an interface between layers in the material, the energy will pass straight through if the energy impedance of the layers are the same. If the energy impedance of the layers are different energy is reflected proportionately to the difference in impedance. Given a block of material such as a ballistic panel comprised of alternating or interleaved layers of SPECTRA SHIELD™ high molecular weight polyethylene filaments in a flexible resin matrix and aramid fiber cloth, it is suggested there is reflection of energy at every material interface. It is proposed that, although the ballistic panel is comprised of loose soft armor, at the moment and point of impact the panel's behavior approaches that of an intimately bonded solid layered block. This would explain the reduction in blunt trauma over a conventional weight of ballistic panel, or conversely, being able to reduce the ballistic panel areal density while maintaining blunt trauma with the applicable standards.

Testing of the interleaved soft body armor according to the present invention was conducted by H.P. White Laboratory Inc. of Street, Md., U.S.A. in accordance with the requirements of National Institute of Justice testing standard NIJ-STD-0101.03, BALLISTIC RESISTANCE OF POLICE BODY ARMOR, dated April 1987 and changes thereto. Results of the testing are tabulated below. Table 1 is a summary of the data set out in Tables 2, 3 and 4.

TABLE 1

| | | Test Sample | | | | | Results | | | |
|---|---|---|---|---|---|---|---|---|---|---|
| | | Weight | Plies | Ballistic Threat* | | | | | Penetra- | Deform. |
| Serial | Testing | (lbs) | (**) | Obliquity | Caliber | Shots | Velocity | Min. | tion | (mm)*** |
| CIIT- | front dry | 2.78 | 2:2:2:1 | 0 | .357 Mag. | 4 | 1451 | 1414 | 0 | 44 |
| 1339 | | | | 30 | .357 Mag. | 2 | 1433 | 1414 | 0 | na |
| 1339 | back dry | 2.97 | 2:2:2:1 | 0 | 9 mm. | 4 | 1225 | 1212 | 0 | 28 |
| | | | | 30 | 9 mm | 2 | 1230 | 1201 | 0 | na |

*Per NIJ-STD-0101.03, Threat Level II
**Spectra:Kevlar:Spectra:Kevlar
***Deformation of clay backing. Maximum allowable: 44 mm.

TABLE 2

| | | | | | | | | | COMPLIES |
|---|---|---|---|---|---|---|---|---|---|
| | | | | | Level: II | | | | yes 1. |
| | | | | | Certification: NO | | | | yes 2. |
| TEST SET-UP | | | | | | | | | |
| 3. Ambient Temp.(deg.F.) 71 | | | , Rel, Humid.(%) 69 | | , Local BP (in Mg) 30.04 | | | | yes 3. |
| 4. Clay Temp.(deg.F.) 80 | | | , Test Range 1 | | , Range(ft.) 16.5 | | | | yes 4. |
| 5. Drop Depth(mm) 25 mm, 26 mm, 28 mm | | | | | | | | | yes 5. |
| TEST PANEL | Front | Back | Front | Back | Front | Back | Front | Back | |
| 6. Vest Size | | | 113A | | | | | 113A | na 6. |
| 7. Vest Wgt (lbs) | | | 2.78 | | | | | 2.97 | na 7. |
| 8. Vest Ser. Num. | | | CIIT | | | | | CIIT | na 8. |
| | | | 1339 | | | | | 1339 | |
| 9. Vest Lot Num. | | | RMK. 3 | | | | | RMK. 3 | na 9. |
| 10. Stitching | | | RMK1,2 | | | | | RMK1,2 | na 10. |
| 11. Vest Material | | | RMK. 4 | | | | | RMK. 4 | na 11. |
| 12. Vest Material | | | | | | | | | na 12. |
| 13. Vest Material | | | | | | | | | na 13. |
| TEST DESCRIPTION | | | | | | | | | |
| 14. Condition | WET | | DRY | | WET | | DRY | | yes 14. |
| 15. Threat (Caliber) | | | .357 Mag. | | | | 9 mm | | yes 15. |
| 16. Velocity (fps) | | | 1395 + 50 | | | | 1175 + 50 | | yes 16. |
| 17. Bullet (gr/type) | | | 158/JSP | | | | 124/FMJ | | yes 17. |
| 18. Factory/H.L. | | | H. L. | | | | H. L. | | na 18. |
| 19. Bullet Manufacturer | | | REMINGTON | | | | REMINGTON | | na 19. |
| 20. Factory Lot Number | | | 22847 | | | | B3552 | | na 20. |
| 21. Gun (Manufacturer) | | | Test Barrel | | | | Test Barrel | | na 21. |
| 22. (Model) | | | na | | | | na | | na 22. |
| 23. (Caliber) | | | .357 Mag. | | | | 9 mm | | na 23. |
| 24. (Serial Number) | | | 237 | | | | 210 | | na 24. |
| 25. (inches) | | | 5.5 | | | | 10.25 | | na 25. |

REMARKS
1 Stitching, Edge: NA
2 Body: NA
3 MFG, LOT #2-608-SH, 003-KV
4 LAYERS (Spectra:Kevlar:Spectra:Kevlar)
5 TEST CONDUCTED ON 5.5" CLAY WITH PLYWOOD BACKING

TABLE 3

Threat (Cal.): .357 Mag.
Conditioned: Dry
Vest Serial No.: CIIT1339

| | FRONT | | | | | | | BACK | | | | | | | COMPLIES | |
|---|---|---|---|---|---|---|---|---|---|---|---|---|---|---|---|---|
| | Seq. | Area | Time (sec) | Vel. (fps) | Fair | Results | Footnotes | Seq. | Area | Time (sec) | Vel. (fps) | Fair | Results | Footnotes | Front | Back |
| 38. | 1 | 1 | .002068 | 1451 | yes | N 44 mm | | | | | | | | | yes | 38. |
| 39. | 2 | 2 | .002083 | 1440 | yes | N 37 mm | | | | | | | | | yes | 39. |
| 40. | 3 | 3 | .002121 | 1414 | yes | N 36 mm | | | | | | | | | yes | 40. |
| 41. | 4 | 4 | .002094 | 1433 | yes | N 31 mm | a | | | | | | | | yes | 41. |
| 42. | 5 | 5 | .002122 | 1414 | yes | N 32 mm | a | | | | | | | | yes | 42. |
| 43. | 6 | 6 | .002089 | 1436 | yes | N 52 mm | | | | | | | | | yes | 43. |
| 44. | | | | | | | | | | | | | | | | 44. |
| 45. | | | | | | | | | | | | | | | | 45. |
| 46. | | | | | | | | | | | | | | | | 46. |
| 47. | | | | | | | | | | | | | | | | 47. |

TABLE 3-continued

Threat (Cal.): .357 Mag.
Conditioned: Dry
Vest Serial No.: CIIT1339

| FRONT | | | | | | | BACK | | | | | | | COMPLIES | |
|---|---|---|---|---|---|---|---|---|---|---|---|---|---|---|---|
| Seq. | Area | Time (sec) | Vel. (fps) | Fair | Results | Footnotes | Seq. | Area | Time (sec) | Vel. (fps) | Fair | Results | Footnotes | Front | Back |
| 48. | | | | | | | | | | | | | | | 48. |
| 49. | | | | | | | | | | | | | | | 49. |

FOOTNOTES
a - 30 degree obliquity impact
b - Excessive Velocity
c - Insufficient Velocity
d - Too close to edge
e - Too close to prior impact
f - Excessive total impacts (test terminated)
g - Excessive area impacts (test terminated)
h - Panel Dismounted
i - Bunching of insert without effect
j - Bunching of insert may have contributed to penetration
k - Impact on seam
RESULTS
P - PENETRATION
N - NO PENETRATION
REMARKS

TABLE 4

Threat (Cal.): .9 mm
Conditioned: Dry
Vest Serial No.: CIIT1339

| FRONT | | | | | | | BACK | | | | | | | COMPLIES | |
|---|---|---|---|---|---|---|---|---|---|---|---|---|---|---|---|
| Seq. | Area | Time (sec) | Vel. (fps) | Fair | Results | Footnotes | Seq. | Area | Time (sec) | Vel. (fps) | Fair | Results | Footnotes | Front | Back |
| 62. | | | | | | | 1 | 1 | .002475 | 1212 | yes | N 28 mm | | 62. | yes |
| 63. | | | | | | | 2 | 2 | .002461 | 1219 | yes | N 27 mm | | 63. | yes |
| 64. | | | | | | | 3 | 3 | .002449 | 1225 | yes | N 26 mm | | 64. | yes |
| 65. | | | | | | | 4 | 4 | .002498 | 1201 | yes | N 25 mm | a | 65. | yes |
| 66. | | | | | | | 5 | 5 | .002439 | 1230 | yes | N 25 mm | a | 66. | yes |
| 67. | | | | | | | 6 | 6 | .002470 | 1215 | yes | N 27 mm | | 67. | yes |
| 68. | | | | | | | | | | | | | | 68. | |
| 69. | | | | | | | | | | | | | | 69. | |
| 70. | | | | | | | | | | | | | | 70. | |
| 71. | | | | | | | | | | | | | | 71. | |
| 72. | | | | | | | | | | | | | | 72. | |
| 73. | | | | | | | | | | | | | | 73. | |

FOOTNOTES
a - 30 degree obliquity impact
b - Excessive Velocity
c - Insufficient Velocity
d - Too close to edge
e - Too close to prior impact
f - Excessive total impacts (test terminated)
g - Excessive area impacts (test terminated)
h - Panel Dismounted
i - Bunching of insert without effect
j - Bunching of insert may have contributed to penetration
k - Impact on seam
RESULTS
P - PENETRATION
N - NO PENETRATION
REMARKS Based on the data presented in Tables 1–4, the soft body armor according to the present invention satisfied the ballistic requirements of the National Institute of Justice Ballistic Resistance of Police Body Armor test standard for threat level II. The present invention applies to three National Institute of Justice standard that levels; namely IIA, II, and IIIA. Threat level IIA is a lesser threat level than threat level II and requires lighter body armor in order to satisfy the test standard as compared to body armor satisfying the test standard for threat level II. Threat level IIIA is an increased threat level over that of threat level II and requires heavier body armor in order to satisfy the test standard as compared to body armor satisfying the test standard for threat level II.

With reference to Tables 1–4, for the sake of comparison ballistic tests were conducted on the one hand between a ballistic sample comprised of one packet having 19 sheets of SPECTRA SHIELD™ high molecular weight polyethylene filaments in a flexible resin matrix overlaying a second packet having 18 sheets of SPECTRA SHIELD™ high molecular weight polyethylene filaments in a flexible resin matrix (hereinafter collectively the "prior art sample"), and on the other hand, an interleaved stack of SPECTRA SHIELD™ high molecular weight polyethylene filaments in a flexible resin matrix and aramid fiber cloth having interleaved layers according to the present invention, each layer having an interleave ratio of 2:1 (Spectra:aramid) for a total of 18 sheets of SPECTRA SHIELD™ high molecular weight polyethylene filaments in a flexible resin matrix and 9 sheets of KEVLAR aramid fiber woven cloth in a total of nine layers. An example of a stack of interleaved layers according to the present invention is depicted in FIG. 1. It is understood threat level II and IIIA body armor would have an increased number of layers over that of threat level IIA body armor.

Ballistic panel 2 has interleaved layers 4. Each of interleaved layers 4 has interleaved plies of SPECTRA SHIELD™ high molecular weight polyethylene filaments in a flexible resin matrix 6 and plies of aramid fiber cloth 8. The interleave ratio is the ratio of the number of plies of SPECTRA SHIELD™ high molecular weight polyethylene filaments in a flexible resin matrix 6 to the number of plies of amid fiber cloth 8 within an interleaved layer 4. Ballistic panel 2 is made up of a stack of layers 4, oriented generally vertically within a soft body armor vest or the like (not shown). Thus layers 4 form an array within ballistic panel 2, ie. a stack of layers 4 turned onto its side so that the array extends between a front face 10 of ballistic panel 2 and a back face 12 of ballistic panel 2. Plies within layers 4 are non-quilted. Layers 4 are not quilted to each other, but rather are held in their generally vertically oriented array between front face 10 and back face 12 by being contained in a pocket or compartment within a soft body armor vest or the like.

Tests were conducted according to the National Institute of Justice (NIJ) Standard for Threat Level II. Thus, ballistic test velocities had to fall between 1395 feet per second and 1445 feet per second for .357 Magnum caliber. Acceptable test velocities for 9 mm caliber were between 1175 feet per second and 1275 feet per second. .357 Magnum caliber ammunition was jacketed soft point (JSP) with a weight of 158 grams. 9 mm caliber was full metal jacket (FMJ) with a weight of 124 grams. The maximum allowable deformation depth was 1.73 inches in a calibrated clay bed used to gauge blunt trauma. The prior art sample had an areal density of 0.85 pounds per square foot as compared to 0.72 pounds per square foot for the soft body armor according to the present invention. The reduced number of sheets of the soft body armor according to the present invention resulted in the soft body armor sample having a lower areal density than the prior art sample.

The soft body armor according to the present invention also did not suffer the drawback encountered with purely aramid fiber cloth prior art soft body armor. In the prior art, aramid fiber sheets used in soft body armor usually have to be quilted, i.e. the sheets of aramid fiber cloth stitched together to reduce pillowing of the aramid fiber sheets upon ballistic impact. The soft body armor according to the present invention did not have to be quilted as the combination of aramid fiber cloth sheets and SPECTRA SHIELD™ high molecular weight polyethylene filaments in a flexible resin matrix sheets in the aforesaid ratio reduced the pillowing tendency of the aramid fiber cloth. As a result of not having to be quilted, the soft body armor of the present invention exhibits improved flexibility over purely aramid fiber cloth soft body armor in the prior art.

Applicant has also noted that indications of blunt trauma are reduced in testing of soft body armor according to the present invention over that of purely aramid fiber soft body armor in that the soft body armor of the present invention results in reduced blunt trauma characteristics more similar to those of purely SPECTRA SHIELD™ high molecular weight polyethylene filaments in a flexible resin matrix soft body armor. It has been observed that purely aramid fibre cloth test samples result in more pointed and deeper deformation upon ballistic impact, that is, in greater indicated blunt trauma, than that of purely SPECTRA SHIELD™ high molecular weight polyethylene filaments in a flexible resin matrix samples or tat of soft body armor according to the present invention.

Similarly, purely SPECTRA SHIELD™ high molecular weight polyethylene filaments in a flexible resin matrix samples exhibit better deformation characteristics than do aramid fiber cloth test samples when impacted at an angle of 30° from an axis orthogonal to the test sample. Applicant has noted that soft body armor according to the present invention exhibit the improved characteristics of a purely SPECTRA SHIELD™ high molecular weight polyethylene filaments in a flexible resin matrix test sample even though aramid fiber sheets are regularly interleaved according to the ratio of the present invention. Flexibility of the soft body armor is increased by the interleaving of aramid fiber cloth sheets because SPECTRA SHIELD™ high molecular weight polyethylene filaments in a flexible resin matrix sheets otherwise have a tendency to stick together. The aramid fiber cloth sheets provide interleaved reduced-friction surfaces between the sheets of SPECTRA SHIELD™ high molecular weight polyethylene filaments in a flexible resin matrix.

Applicant also notes that the improved fire-resistant characteristics of aramid fiber cloth over those of SPECTRA SHIELD™ high molecular weight polyethylene filaments in a flexible resin matrix improves the overall protection of the soft body armor according to the present invention even though the interleaved soft body armour of the present invention includes SPECTRA SHIELD™ high molecular weight polyethylene filaments in a flexible resin matrix which has reduced fire resistant qualities. Similarly, Applicant notes that the soft body armor of the present invention retains the improved ballistic resistance characteristics of SPECTRA SHIELD™ high molecular weight polyethylene filaments in a flexible resin matrix when the soft body armor is wet even though the interleaved soft body armor of the present invention includes aramid fiber sheets which in purely aramid fiber soft body armor have degraded ballistic resistance characteristics when wet.

In an alternative embodiment, the soft body armor of the present invention combines SPECTRA SHIELD™ high molecular weight polyethylene filaments in a flexible resin matrix and aramid fiber cloth sheets in an interleaved ballistic panel comprising sheets of aramid fiber cloth alternating between sheets of SPECTRA SHIELD™ high molecular weight polyethylene filaments in a flexible resin matrix in a 1:1 ratio or in an initially 2:2:2:1 ratio (S:A:S:A) which continues in layers of 2:1 (S:A) so long as the total number of sheets of SPECTRA SHIELD™ high molecular weight polyethylene filaments in a flexible resin matrix is not less than the total number of sheets of aramid fibre cloth in the ballistic panel.

In summary, the proposed interleaved configurations improve the performance of a soft body armor ballistic panel as indicated by a reduction in areal density while maintaining National Institute of Justice performance standards. This increase in performance is attributed to a reduction in penetration of the ballistic round into the ballistic panel and a reduction of blunt trauma behind the ballistic panel. As the performance of the ballistic panel increases, plies of fabric may be removed, reducing the areal density while maintaining a performance capability satisfying NIJ Standard 0101.03. The end result therefore is NIJ Standard 0101.03 blunt trauma performance comparable to prior art ballistic panel combinations, with improved comfort for the wearer through reduced weight (areal density), increased flexibility, reduced heat retention and increased moisture resistance.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. Soft body armor for threat level II ballistic performance projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies or said sheets of polyethylene filaments to plies of said aramid fiber woven cloth within each layer of said plurality of layers, so as to form a multiplicity of impedance mis-matched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within each layer of said plurality of layers is between 1:1 and 4:4, and wherein the total number of said plies of said sheets of polyethylene filaments is equal to or greater than the total number of said plies of aramid fiber woven cloth within said plurality of layers, and wherein said plurality of layers comprises at least six of said layers interleaved in said ballistic panel, and wherein said interleave ratio in each of said layers of said plurality of layers changes from said front face of said ballistic panel to said back face of said ballistic panel.

2. The soft body armor of claim 1 wherein said interleave ratio is between 1:1 and 3:3.

3. The soft body armor of claim 1 wherein said interleave ratio is between 1:1 and 2:2.

4. Soft body armor for threat level II ballistic performance projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies or said sheets of polyethylene filaments to plies of said aramid fiber woven cloth within each layer of said plurality of layers, so as to form a multiplicity of impedance mis-matched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within each layer of said plurality of layers is 2:2 and wherein the total number of said plies of said sheets of polyethylene filaments is equal to or greater than the total number of said plies of aramid fiber woven cloth within said plurality of layers, and wherein said plurality of layers comprises at least six of said layers interleaved in said ballistic panel.

5. Soft body armor for threat level II ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within each layer of said plurality of layers is between 2:1 (polyethylene:aramid) and 4:2 (polyethylene:aramid), and wherein said plurality of layers comprises at least six of said layers interleaved in said ballistic panel, and wherein said interleave ratio in each of said layers of said plurality of layers changes from said front face of said ballistic panel to said back face of said ballistic panel.

6. Soft body armor for threat level II ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within each layer of said plurality of layers is 2:1 (polyethylene:aramid), and wherein said plurality of layers comprises at least six of said layers interleaved in said ballistic panel.

7. Soft body armor for threat level II ballistic performance against deforming ballistic projectiles comprising a ballistic panel having an interleaved construction of a generally vertically oriented plurality of layers non-quilted of interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within a layer of said plurality of layers is 2:2:2:1 (polyethylene:aramid:polyethylene:aramid), and wherein the total number of said plies of said sheets of polyethylene filaments is equal to or greater than the total number of said plies of aramid fiber woven cloth within said plurality of layers, and wherein said plurality of layers comprises at least six of said layers interleaved in said ballistic panel, and wherein said interleave ratio in each of said plurality of layers changes from said front face of said ballistic panel to said back face of said ballistic panel.

8. Soft body armor for threat level IIIA ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within each layer of said plurality of layers is between 1:1 and 4:4, and wherein the total number of said plies of said sheets of polyethylene filaments is equal to or greater than the total number of said plies of aramid fiber woven cloth within said plurality of layers, and wherein said plurality of layers comprises at least six of said layers interleaved in said ballistic panel, and wherein said interleave ratio in each of said layers of said plurality of layers changes from said front face of said ballistic panel to said back face of said ballistic panel.

9. The soft body armor of claim 8 wherein said interleave ratio is between 1:1 and 3:3.

10. The soft body armor of claim 8 wherein said interleave ratio is between 1:1 and 2:2.

11. Soft body armor for threat level IIIA ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within each layer of said plurality of layers is 2:2, and wherein the total number of said plies of said sheets of polyethylene filaments is equal to or greater than the total number of said plies of aramid fiber woven cloth within said plurality of layers, and wherein said plurality of layers comprises at least six of said layers interleaved in said ballistic panel.

12. Soft body armor for threat level IIIA ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within each layer of said plurality of layers is between 2:1 (polyethylene:aramid) and 4:2 (polyethylene:aramid), and wherein said plurality of layers comprises at least six of said layers interleaved in said ballistic panel, and wherein said interleave ratio in each of said layers of said plurality of layers changes from said front face of said ballistic panel to said back face of said ballistic panel.

13. Soft body armor for threat level IIIA ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within each layer of said plurality of layers is 2:1 (polyethylene:aramid), and wherein said plurality of layers comprises at least six of said layers interleaved in said ballistic panel.

14. Soft body armor for threat level IIIA ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within a layer of said plurality of layers is 2:2:2:1 (polyethylene:aramid:polyethylene:aramid), and wherein the total number of said plies of said sheets of polyethylene filaments is equal to or greater than the total number of said plies of aramid fiber woven cloth within said plurality of layers, and wherein said plurality of layers comprises at least six of said layers interleaved in said ballistic panel, and wherein said interleave ratio in each of said layers of said plurality of layers changes from said front face of said ballistic panel to said back face of said ballistic panel.

15. Soft body armor for threat level IIA ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within each layer of said plurality of layers is between 1:1 and 4:4, and wherein the total number of said plies of said sheets of polyethylene filaments is equal to or greater than the total number of said plies of aramid fiber woven cloth within said plurality of layers, and wherein said plurality of layers comprises at least five of said layers interleaved in said ballistic panel, and wherein said interleave ratio in each of said layers of said plurality of layers changes from said front face of said ballistic panel to said back face of said ballistic panel.

16. The soft body armor of claim 15 wherein said interleave ratio is between 1:1 and 3:3.

17. The soft body armor of claim 15 wherein said interleave ratio is between 1:1 and 2:2.

18. Soft body armor for threat level IIA ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within each layer of said plurality of layers is 2:2, and wherein the total number of said plies of said sheets of polyethylene filaments is equal to or greater than the total number of said plies of aramid fiber woven cloth within said plurality of layers, and wherein said plurality of layers comprises at least five of said layers interleaved in said ballistic panel.

19. Soft body armor for threat level IIA ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within each layer of said plurality of layers is between 2:1 (polyethylene:aramid) and 4:2 (polyethylene:aramid), and wherein said plurality of layers comprises at least five of said layers interleaved in said ballistic panel, and wherein said interleave ratio in each of said layers of said plurality of layers changes from said front face of said ballistic panel to said back face of said ballistic panel.

20. Soft body armor for threat level IIA ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within each layer of said plurality of layers is 2:1 (polyethylene:aramid), and wherein said plurality of layers comprises at least five of said layers interleaved in said ballistic panel.

21. Soft body armor for threat level IIA ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within a layer of said plurality of layers is 2:2:2:1 (polyethylene:aramid:polyethylene:aramid), and wherein the total number of said plies of said sheets of polyethylene filaments is equal to or greater than the total number of said plies of aramid fiber cloth within said plurality of layers, and wherein said plurality of layers comprises at least five of said layers interleaved in said ballistic panel, and wherein said interleave ratio in each of said layers of said plurality of layers changes from said front face of said ballistic panel to said back face of said ballistic panel.

22. Soft body armor for threat level II ballistic performance against deforming ballistic projectiles comprising a ballistic panel having an interleaved construction of a generally vertically oriented plurality of layers non-quilted of interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within a layer of said plurality of layers is 2:2:2:1 (polyethylene:aramid:polyethylene:aramid), and wherein the total number of said plies of said sheets of polyethylene filaments is equal to or greater than the total number of said plies of aramid fiber woven cloth within said plurality of layers, and wherein said plurality of layers comprises at least six of said layers interleaved in said ballistic panel.

23. Soft body armor for threat level IIIA ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within a layer of said plurality of layers is 2:2:2:1 (polyethylene:aramid:polyethylene:aramid), and wherein the total number of said plies of said sheets of polyethylene filaments is equal to or greater than the total number of said plies of aramid fiber woven cloth within said plurality of layers, and wherein said plurality of layers comprises at least six of said layers interleaved in said ballistic panel.

24. Soft body armor for threat level IIA ballistic performance against deforming ballistic projectiles comprising a ballistic panel having an interleaved construction of a generally vertically oriented plurality of layers of non-quilted interleaved sheets of aramid fiber woven cloth and sheets of high molecular weight polyethylene filaments in a flexible resin matrix adjacently interleaved in an interleave ratio of plies of said sheets of polyethylene filaments to plies of said aramid fiber woven cloth within each layer of said plurality of layers, so as to form a multiplicity of impedance mismatched transition zones in an array between a front face of said ballistic panel and a back face of said ballistic panel, said plurality of layers forming a non-quilted array between said front face of said ballistic panel and said back face of said ballistic panel, wherein said interleave ratio of plies of said sheets of polyethylene filaments to plies of aramid fiber woven cloth within a layer of said plurality of layers is 2:2:2:1 (polyethylene:aramid:polyethylene:aramid), and wherein the total number of said plies of said sheets of polyethylene filaments is equal to or greater than the total number of said plies of aramid fiber cloth within said plurality of layers, and wherein said plurality of layers comprises at least five of said layers interleaved in said ballistic panel.

* * * * *